United States Patent [19]

Kayson

[11] 4,101,211

[45] Jul. 18, 1978

[54] MAGNETIC CURTAIN SEAL FOR DEVELOPMENT APPARATUS

[75] Inventor: Walter Kayson, Rochester, N.Y.

[73] Assignee: Eastman Kodak Company, Rochester, N.Y.

[21] Appl. No.: 704,215

[22] Filed: Jul. 12, 1976

[51] Int. Cl.[2] ..... G03G 15/00

[52] U.S. Cl. ..... 355/3 DD; 118/653

[58] Field of Search ..... 355/3 DD, 3 R; 118/654, 118/657, 653; 427/18

[56] References Cited

U.S. PATENT DOCUMENTS

| | | | |
|---|---|---|---|
| 3,764,208 | 10/1973 | Takahashi et al. | 355/3 DD |
| 3,791,730 | 2/1974 | Sullivan | 355/3 DD |
| 3,906,899 | 9/1975 | Harpavat | 118/657 X |
| 3,981,272 | 9/1976 | Smith et al. | 355/3 DD |
| 4,007,707 | 2/1977 | Buchan et al. | 355/3 DD |

*Primary Examiner*—Richard L. Moses
*Attorney, Agent, or Firm*—R. L. Owens

[57] ABSTRACT

For use in an electrographic development apparatus having a development station and a sump wherein at least one auger moves developer between the sump and the development station, a magnetic curtain seal is disposed adjacent the auger proximate to the auger passageway (between sump and development station) and attracts sufficient developer to block the auger passageway and thereby prevent toner dust from escaping from the sump into the development station.

1 Claim, 6 Drawing Figures

MAGNETIC CURTAIN SEAL FOR DEVELOPMENT APPARATUS

CROSS-REFERENCES TO RELATED APPLICATION

Reference is made to commonly assigned co-pending U.S. Pat. application Ser. No. 558,522, entitled: Toner Handling Apparatus, filed on Mar. 14, 1975 in the names of Katusha et al.

BACKGROUND OF THE INVENTION

This invention relates to development apparatus for using toner to develop electrostatic images carried on an insulating surface, and more particularly, to apparatus for reducing contamination of such surface by toner dust.

In electrography, it is common to form an electrostatic image on an insulating surface of an electrophotographic member in the form of a drum or web and to develop that image by applying toner particles thereto. In many commercial applications, the toner is either transferred in an image-wise configuration to another surface and then fixed or is fixed to the insulating surface itself. In processes in which the toner is transferred from the insulating surface prior to fixing, the insulating surface generally is reused.

Triboelectric developing systems are frequently used in the development of electrostatic images. In such systems, finely divided toner particles are held to the surface of much larger carrier particles by electrostatic charges created by triboelectrification, forming a mixture (herein called a developer). When the developer is brought into contact with an electrostatic image, the charge on the image attracts the triboelectrically charged toner and overcomes the attraction of the carrier for the toner thereby developing the image.

Among triboelectric developing systems, the most commonly used are cascade systems and magnetic brush systems. In cascade systems, gravity is used to roll developer across the image. Because cascade systems use gravity as their primary moving force, they are necessarily speed limited. In automatic machines, a cascade recirculation system generally requires substantial machine space.

In magnetic brush systems, the carrier particles are ferromagnetic in nature. These ferromagnetic carrier particles are held to an applicator surface, for example, a nonmagnetic cylinder, in a bristle formation, by magnets located inside the cylinder. The bristles are brushed across a surface carrying an electrostatic image. The electrostatic attraction between the toner and the charged image overcomes the triboelectrically created attraction between toner and ferromagnetic particles and the image is developed. Areas of the image exerting less attractive force on the toner than is exerted by the carrier are cleaned of toner as they are brushed.

In one form of magnetic brush development apparatus, measured amounts of toner are added in a sump to the developer to maintain a proper developer mixture of toner, and carrier (magnetic) particles. The toner is folded into the developer mixture by feed and return augers and a mixing wheel. The feed auger moves the developer from the sump through a passageway into a development station wherein the magnetic brush(s) is disposed. The return auger moves developer from the station back through a passageway into the sump. This type of development apparatus will be described more fully in the detailed description which follows. The toner added to the sump is in the form of a very fine toner dust. In the sump a dust cloud of toner which is not strongly attracted to the carrier in the developer may be formed above the developer surface. The augers will cause circulation of air from the sump into the development station. Thus toner dust can enter the development station and deposit on the electrophotographic member. Also, toner dust can leak out of the development station into the copier machine and cause contamination of vital machine components.

SUMMARY OF THE INVENTION

In accordance with the invention, there is provided a development apparatus wherein developer is moved by at least one auger between a sump and a development station. A magnetic curtain seal is provided adjacent to the auger and the passageway between the sump and station to prevent air born toner from being transferred from the sump to the development station.

An important feature of this invention is that leakage of toner dust can be minimized without causing a significant increase in the power required to drive the auger. This feature will be explained further in the description of the preferred embodiment which follows.

Description of the Preferred Embodiment

Figure 1:
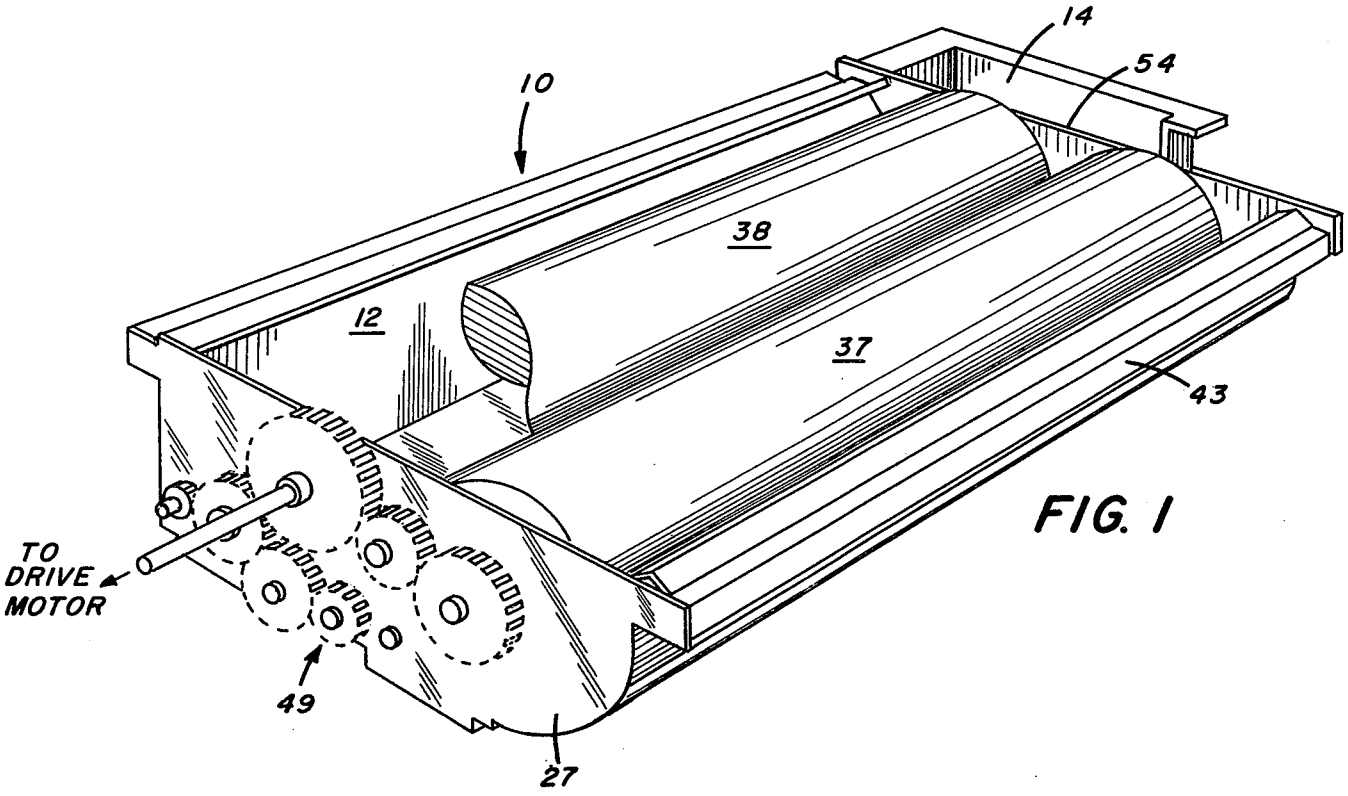
FIG. 1 is a pictorial perspective representation of development apparatus, having a development station and a sump with certain parts not shown for clarity of illustration.
Figure 2:
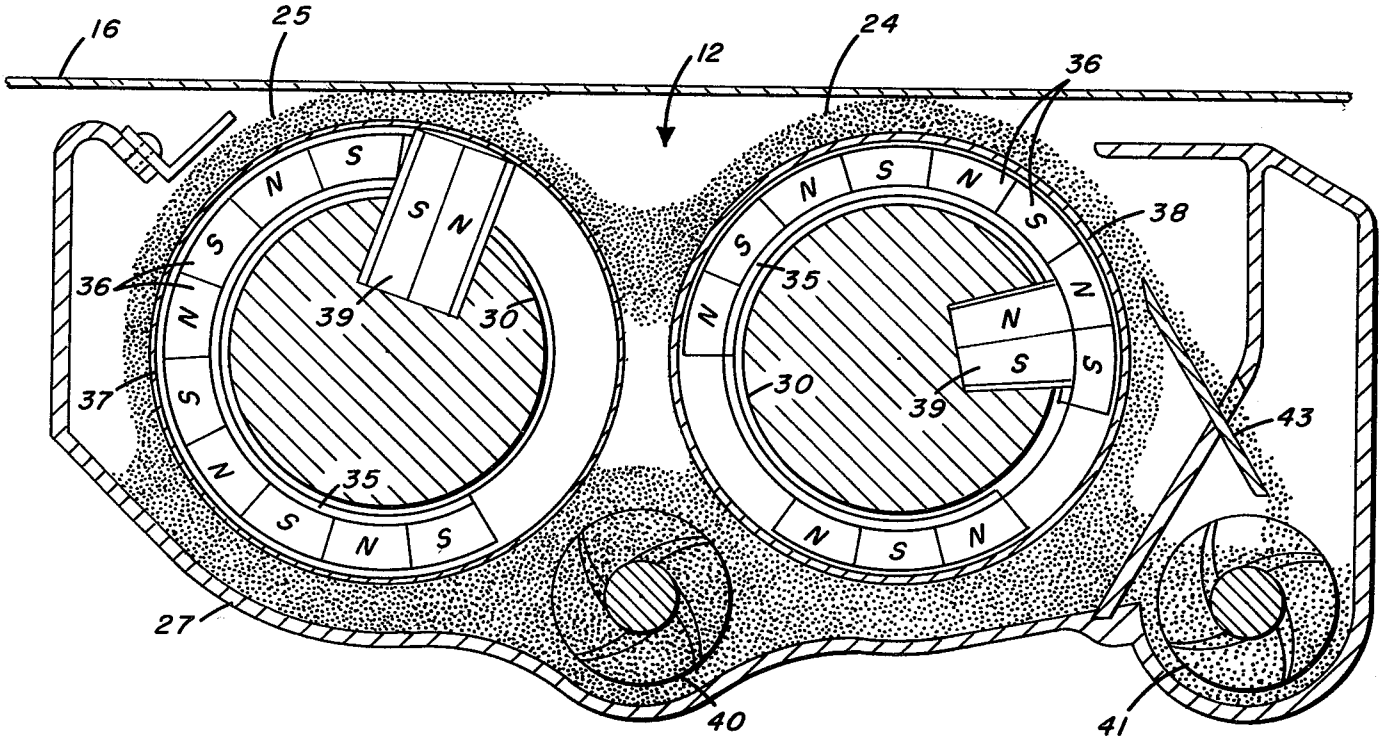
FIG. 2 is a schematic cross-sectional representation of the development station portion of the development apparatus of FIG. 1.

Referring to FIGS. 1 and 2 there is shown a development apparatus 10 which includes a development station 12 and a sump 14. The development apparatus uses a developer, which is a mixture of toner and carrier particles that are typically ferromagnetic in nature. First the development station and the sump will be briefly described. Finally, magnetic curtains on the augers in the sump will be described.

In the development station 12 as shown in FIGS. 1 and more particularly in FIG. 2, an electrostatic charge pattern carried on an insulating surface of a moving electrophotographic member is in the form of a web 16 (often this electrophotographic web is referred to in the art as a photoconductor or a film). The web 16 is moved past a development magnetic brush 24 and a feed magnetic brush 25 mounted in a developer housing 27 which holds a supply of developer. The brushes can be constructed individually according to a variety of designs known in the prior art. According to FIG. 2 a preferred design for this application includes a stationary core 30 of nonmagnetic material around which is mounted a stationary magnetic pole piece 35 that may be made of soft steel or other magnetic material. Mounted around part of the circumference of the pole piece 35 is a series of permanent magnets 36, for example, rubber bonded barium ferrite magnetic strips or poles. Larger magnets 39 are also employed to help the flow of developer through the development station. Concentric with the arrangement of these elements and on the outside thereof are rotatable, preferably grooved, nonmagnetic, rollers namely transport roller 37 and developer roller 38. Each brush is constructed so that, as the rollers 37 and 38 rotate, developer particles are held on their surfaces and moved with the roller while in the field of the magnetic strips.

The stationary magnets 36 and 39 attract the developer to the rollers 37 and 38. The magnetic field from the internal magnets causes the developer to coat the roller surfaces so that they appear like a fine-bristled brush. It is the surface of this coating which actually touches the web 16 to supply toner to the charged image area.

As noted above, the developer consists of the carrier granules and the toner particles. The carrier granules transport the much smaller toner particles to the film web. The iron carrier granules are transported around the roller 37, by magnets within the roller, and are thereby placed in contact with the film belt.

In developing the copy image, toner is constantly removed from the developer and carried away on the film for later transfer to a copy paper. The carrier granules are retained in the developer for reuse. Within the development station 12 are also disposed feed and return augers 40 and 41 respectively. These augers will be described more fully later in this specification. It should be noted, that a skive 43 strips off a portion of the developer from the development brush and directs it to the return auger 41. For a more detailed description of a similar development station, reference may be made to commonly assigned U.S. Pat. No. 3,543,720 issued Dec. 1, 1970 in the names of Drexler et al.

Figure 5:
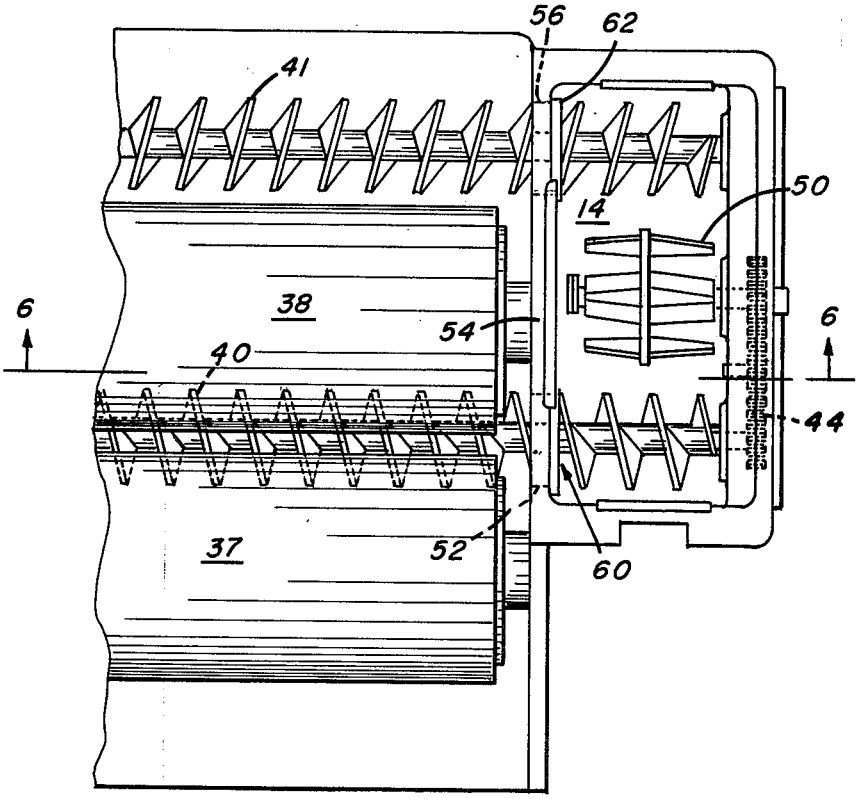
FIG. 5 is a partial top plan view of the development apparatus showing the arrangement of augers, mixing wheel, sump and curtain seals.
Figure 6:
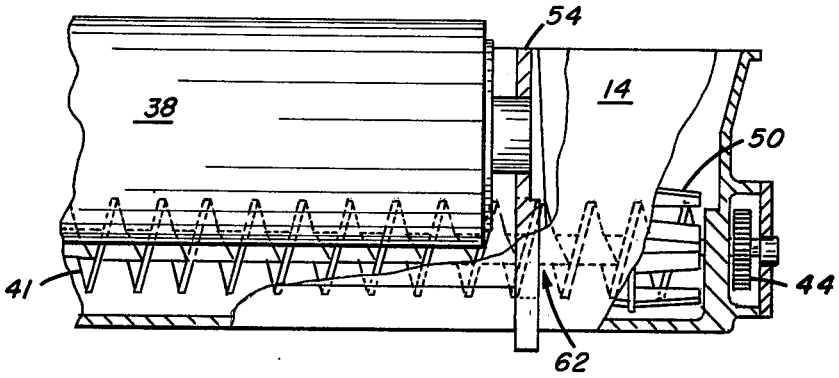
FIG. 6 is a cross-sectional view taken along the lines 6—6 of FIG. 5.

The sump 14 is shown in detail in FIGS. 5 and 6 and is disposed near the ends of brushes 24 and 25 at one end of the development station 12. The sump 14 contains a mixing wheel 50 and end portions of the augers 40 and 41 which mechanically mix the toner as it is added into the developer. The mixing wheel 50 also moves the developer from the return auger 41 to the feed auger 40. This wheel is mounted in a sleeve bearing at the wall of the sump housing and is driven by a gearing arrangement 44 through the feed auger 40. The drive means includes a drive motor (not shown) for driving the augers by means of a gear train 49 connected to such motor (at the front of development station in FIG. 1). The gearing 49 will not be described in detail since it will be understood that any conventional drive train can be used. For another example of such gearing drive means, see FIG. 2 of the aforementioned U.S. Pat. No. 3,543,720.

Both of the Augers 40 and 41 are elongated helical members which may be made of molded plastic or from metal such as cast aluminum or other nonmagnetic material. The feed auger 40, is located near the bottom center of the development station 12 and the sump 14. In the sump it mixes the developer and newly added toner and moves the developer through a passageway 52 formed in a wall 54 from the sump 14 to the developer station 12. The auger 40 rides in sealed bearings (not shown) at the sump 14 and station 12 respectively and is driven by the gear train 49. It also transmits mechanical drive power to the mixing wheel 50.

The return auger 41 (see FIGS. 1 and 2) is at the bottom right of the development station 12 and the sump 14. It moves the developer from the station to the sump through a passageway 56 in the wall 54. The return auger rides in sealed bearings (not shown) at the sump and station respectively and is driven by the rear gear train 49.

A toner replenishment mechanism (not shown) is secured to the top opening of the sump 14. From time to time it adds measured amounts of toner to the developer in the sump to maintain a proper concentration of toner and carrier particles. An example of such a mechanism is set forth in the Katusha et al patent application referred to in the section of this application entitled: "Cross Reference to Related Application".

Figure 3:
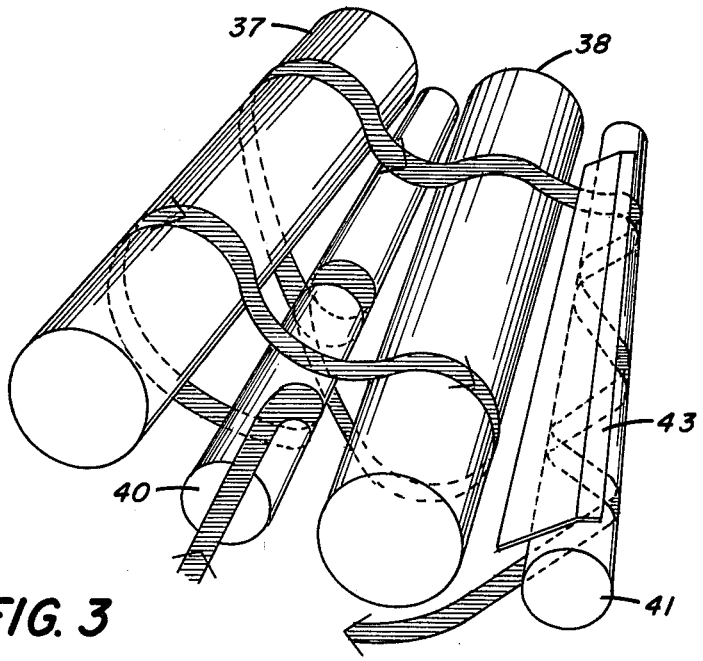
FIG. 3 is a schematic representation showing the flow of developer in the development apparatus of FIG. 1.

The combined motion of the rollers and augers circulates the developer as shown in FIG. 3. Starting in the sump 14, the developer is moved by the feed auger 40 from the sump into the development station 12. The iron carrier particles are attracted to the magnets inside the transport roller 37, and the developer moves toward the left. As the developer contacts the transport roller 37, it is moved clockwise around the roller 37 by grooved surface (not shown) in the roller 37. The developer is carried into contact with the film 16 at the top of the transport roller 37. The transport roller 37 continues to move the developer into the space between the transport and developer rollers 37 and 38, respectively. At this point, there are no magnets in the transport roller 37, but there are magnets at this position in the developer roller 38, so the developer is now attracted to the developer roller 38. The developer is now carried clockwise up and again into contact with the film 16. The grooved developer roller 38 then continues to move the developer around and back to the feed auger 40. The feed auger again moves the developer some distance toward the rear of the station until it is again picked up by the transport roller 37. These three devices, the feed auger 40, the transport roller 37, and the developer roller 38, give the developer mix a spiral track from the front to the rear of the development station.

As previously mentioned, the skive plate 43 scrapes some of the developer mix from the development roller 38 and directs it to the return auger 41. The return auger 41 moves some of the developer once again to the sump 14.

The toner that is deposited by the replenishment mechanism into the sump has the appearance of a very fine dust. In the air above the developer a cloud of toner is formed by the combined action replenishment mechanism adding toner and by the agitation of the mixing wheel 50. Toner dust can escape from the sump through the passageways 52 and 56 which receive the augers 41 and 40, respectively. This is especially true for passageway 52 because the feed auger 40 creates a flow of air, above the top level 82 of the developer, from the sump 14 into the development station. If the top level 82 of developer in the sump 14 was above the top of the passageways 52 and 56, no toner dust could escape into the development station 12. This would be undesirable since the augers 40 and 41 would require relatively large torques to move more developer then necessary thereby requiring a considerable amount of extra power consumption. One of the more significant requirements of current copiers is to minimize power usage.

Figure 4:
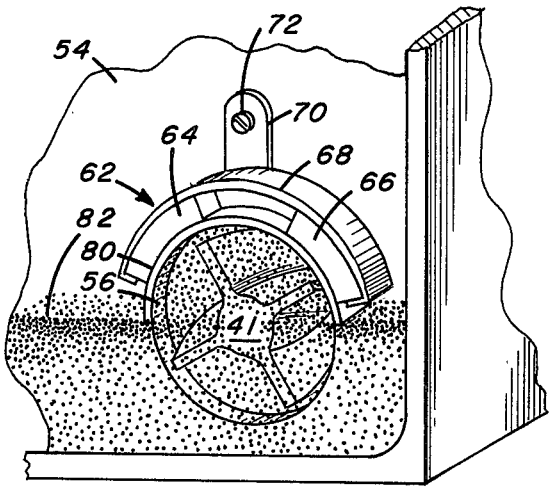
FIG. 4 is a fragmentary view of one of the magnetic curtain seals which is disposed in the sump of FIG. 1.

In accordance with the invention, as shown in FIGS. 5 and 6 containment of dust in the sump 14 is achieved by providing magnetic curtain seals 60 and 62 in the sump adjacent the augers at the entrance to their respective passageways 52 and 56. Since the magnetic curtains seals 60 and 62 are identical in construction only seal 62 as shown in detail in FIG. 4 will be described. Seal 62 includes two spaced permanent magnets 64 and 66 which are fixedly secured, say by gluing, to a metalic keeper or magnetic shunt member 68. Fixed to the keeper is nonmagnetic tab portion 70 which permits the curtain seal to be fixed to the wall 54 by a machine screw 72 or the like. The keeper 68 limits stray magnetic flux and prevents a build up of developer on the top of the magnets 64 and 66. An arcuate metalic shoe 80 is fixed to the bottom of both magnets. In operation, developer is attracted to the shoe 80 and blocks the flow of air through the passageway 56 to thereby minimize toner dust from escaping from the sump into the development station. The size of the magnets is selected such that a sufficient amount of developer is attached to the shoe 80, to block the passageway 56. However, the magnetic attractive force of the magnets 64 and 66 is not so large that the developer attracted to the shoe 80 increases the torque delivered by the gear train 49 which is required to drive the augers. This is an important advantage of the present invention. In operation a curtain of developer is formed which blocks the passageway 56 to loose toner powder. As shown in FIG. 4, this curtain extends downwardly to the top level 82 of the developer in the sump 14. When the phrase "block the passaway" has been used in this specification it means a formation of developer (curtain seal) which prevents toner dust from escaping from the sump into the development station.

The invention has been described in detail with particular reference to a preferred embodiment thereof, but it will be understood that variations and modifications can be effective within the spirit and scope of the invention as described hereinabove and as defined in the appended claims. For example, although the magnetic curtain seals are shown in the sump they also could have been provided in the development station at the passageways. Further, the present invention is not limited for use with magnetic brushes, but is suitable with other development apparatus which uses an auger to transfer developer between a sump and a development station. Further magnetic curtain seals may be effectively employed with other toner transport devices which move developer through passageways, such as conveyor belts, other rotary transports, vibrators or the like.

I claim:

1. In an electrographic development apparatus including a sump for receiving developer having toner and magnetic particles, and a development station having means for applying toner to an electrostatic image carried on an insulating surface, and at least one rotatable auger disposed in a passageway formed between the sump and the development station, the improvement comprising:

magnetic curtain seal means having a magnetic shunt member and a plurality of magnets connected to said shunt member, said magnetic curtain seal means being disposed relative to said auger and said passageway for attracting a portion of the developer to block a part of said passageway, whereby toner dust is prevented from escaping from said sump through such blocked portion of said passageway into said development station.

* * * * *